US012440029B2

(12) United States Patent
Xin et al.

(10) Patent No.: US 12,440,029 B2
(45) Date of Patent: Oct. 14, 2025

(54) RECLINING FOLDABLE CHAIR AND METHOD OF OPERATION

(71) Applicant: ESCORT OUTDOOR LLC, Walnut, CA (US)

(72) Inventors: Yang Cong Xin, Anhui (CN); Yang Lei, Anhui (CN)

(73) Assignee: Escort Outdoor LLC, Walnut, CA (US)

( * ) Notice: Subject to any disclaimer, the term of this patent is extended or adjusted under 35 U.S.C. 154(b) by 178 days.

(21) Appl. No.: 18/464,719

(22) Filed: Sep. 11, 2023

(65) Prior Publication Data

US 2024/0081536 A1 Mar. 14, 2024

Related U.S. Application Data

(60) Provisional application No. 63/375,172, filed on Sep. 9, 2022.

(51) Int. Cl.

| | |
|---|---|
| ***A47C 4/28*** | (2006.01) |
| ***A47C 1/027*** | (2006.01) |
| ***A47C 7/62*** | (2006.01) |
| ***A47C 7/70*** | (2006.01) |

(52) U.S. Cl.

CPC ..... *A47C 4/283* (2013.01); *A47C 1/027* (2013.01); *A47C 7/624* (2018.08); *A47C 7/70* (2013.01)

(58) Field of Classification Search

CPC ..... A47C 4/28; A47C 4/283

See application file for complete search history.

(56) References Cited

U.S. PATENT DOCUMENTS

| | | | | |
|---|---|---|---|---|
| 2,926,724 | A * | 3/1960 | Rittenberg | A47C 7/66 297/53 |
| 7,918,495 | B2 * | 4/2011 | Chen | A47C 4/34 297/42 |
| 8,251,442 | B2 * | 8/2012 | Grace | A47C 4/286 297/16.2 |
| 10,888,163 | B2 * | 1/2021 | Cook | A47C 4/045 |
| 11,534,000 | B2 | 12/2022 | Cook et al. | |
| 2002/0043822 | A1 * | 4/2002 | Choi | A47C 4/46 297/16.2 |
| 2011/0018312 | A1 * | 1/2011 | Grace | A47C 4/045 297/16.2 |
| 2014/0167455 | A1 * | 6/2014 | Holland | A47C 4/286 297/16.2 |
| 2016/0206101 | A1 * | 7/2016 | Grace | A47C 4/283 |
| 2019/0313799 | A1 * | 10/2019 | Frankel | A47C 4/283 |

(Continued)

*Primary Examiner* — Timothy J Brindley

(74) *Attorney, Agent, or Firm* — Grossman, Tucker, Perreault & Pfleger, PLLC; Paul J. Kroon

(57) ABSTRACT

A reclining foldable chair includes a support frame and a seat cover secured to the support frame. The support frame is configured to transition between a storage and use position and includes a first and second upright, a seat bottom support, a collapsible cross-brace, a seat back rest, and a reclining assembly configured to allow the chair to transition between upright and reclined positions. The reclining assembly includes a recline limiter and a pivoting link latch. The pivoting link latch includes a pivoting link and a moving link, wherein an overall length between opposite ends of the pivoting link and moving link is adjustable in order to transition the reclining foldable chair between the upright and reclined positions.

18 Claims, 10 Drawing Sheets

(56) References Cited

U.S. PATENT DOCUMENTS

| | | | | |
|---|---|---|---|---|
| 2019/0350364 | A1* | 11/2019 | Yang | A47C 1/0342 |
| 2020/0323344 | A1* | 10/2020 | Zhu | A47C 4/283 |
| 2025/0000261 | A1* | 1/2025 | Lu | A47C 4/00 |

* cited by examiner

RECLINING FOLDABLE CHAIR AND METHOD OF OPERATION

CROSS-REFERENCE TO RELATED APPLICATIONS

The present application claims the benefit of the filing date of U.S. Provisional Application Ser. No. 63/375,172, filed Sep. 9, 2022, the entire teachings of which application is hereby incorporated herein by reference.

TECHNICAL FIELD

The present disclosure is directed to chairs generally, more particularly to reclining portable chairs and methods of operation.

BACKGROUND INFORMATION

Portable chairs are useful for a variety of circumstances where a user may want to be able to sit in a location wherein a chair is not readily available. One known type of portable chairs include foldable chairs. Foldable chairs may allow the user to partially reduce their overall size thereby facilitating the portability of the chair. In order to further increase the comfort of foldable portable chairs, it is beneficial to allow the user of the foldable chair to select from multiple seating positions, such as selecting between an upright seating position and a reclined seating position.

BRIEF DESCRIPTION OF THE DRAWINGS

Features and advantages of various embodiments of the claimed subject matter will become apparent as the following Detailed Description proceeds, and upon reference to the Drawings, wherein like numerals designate like parts, and in which:

Although the following Detailed Description will proceed with reference being made to illustrative embodiments, many alternatives, modifications, and variations thereof will be apparent to those skilled in the art.

DETAILED DESCRIPTION

In the following description of the various examples and components of this disclosure, reference is made to the accompanying drawings, which form a part hereof, and in which are shown by way of illustration various example structures and environments in which aspects of the disclosure may be practiced. It is to be understood that other structures and environments may be utilized and that structural and functional modifications may be made from the specifically described structures and methods without departing from the scope of the present disclosure.

Figure 1A:
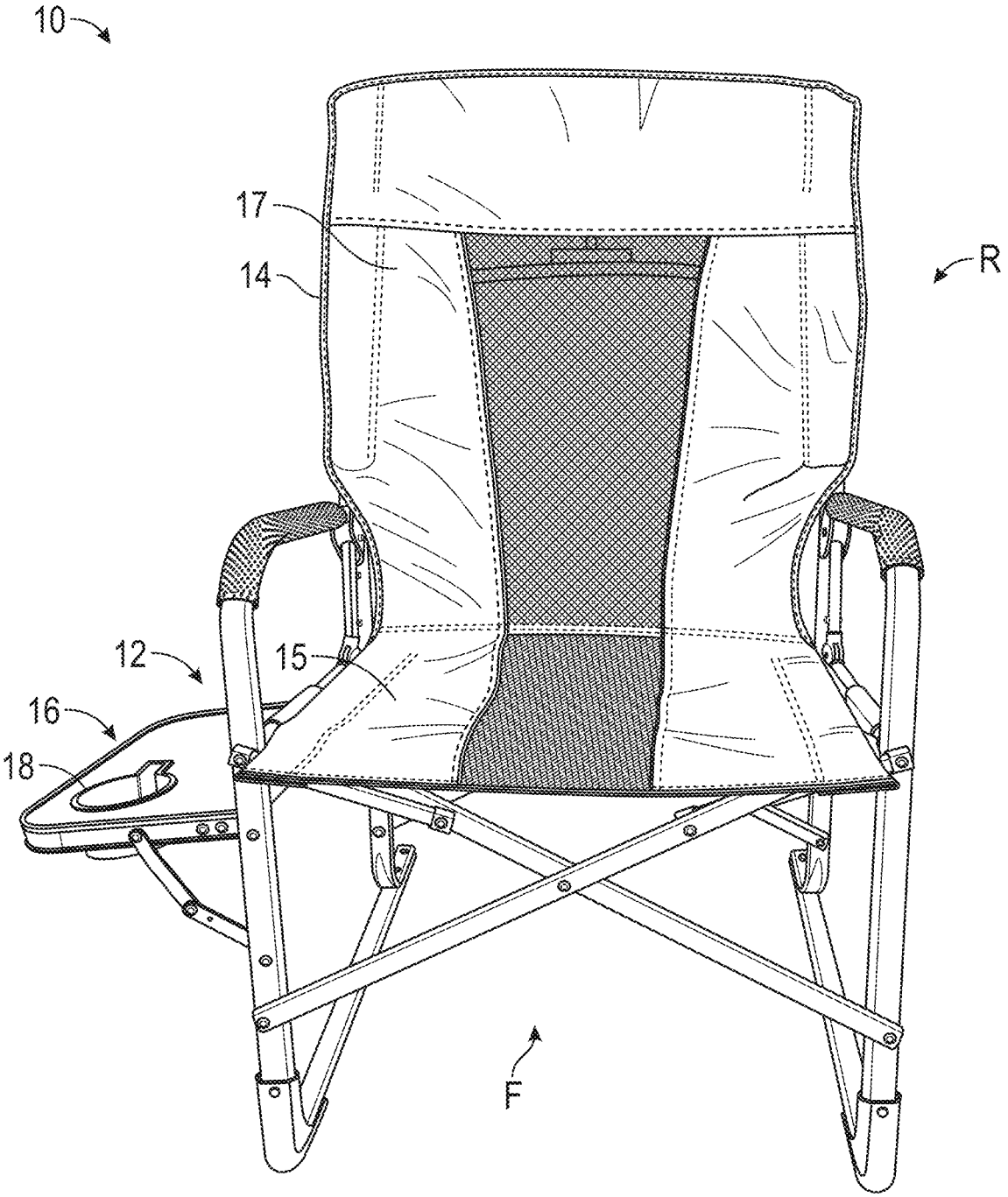
FIG. 1A generally illustrates a front view of one example of a reclining foldable chair in one of a plurality of use positions, in accordance with at least one embodiment described herein.
Figure 1B:
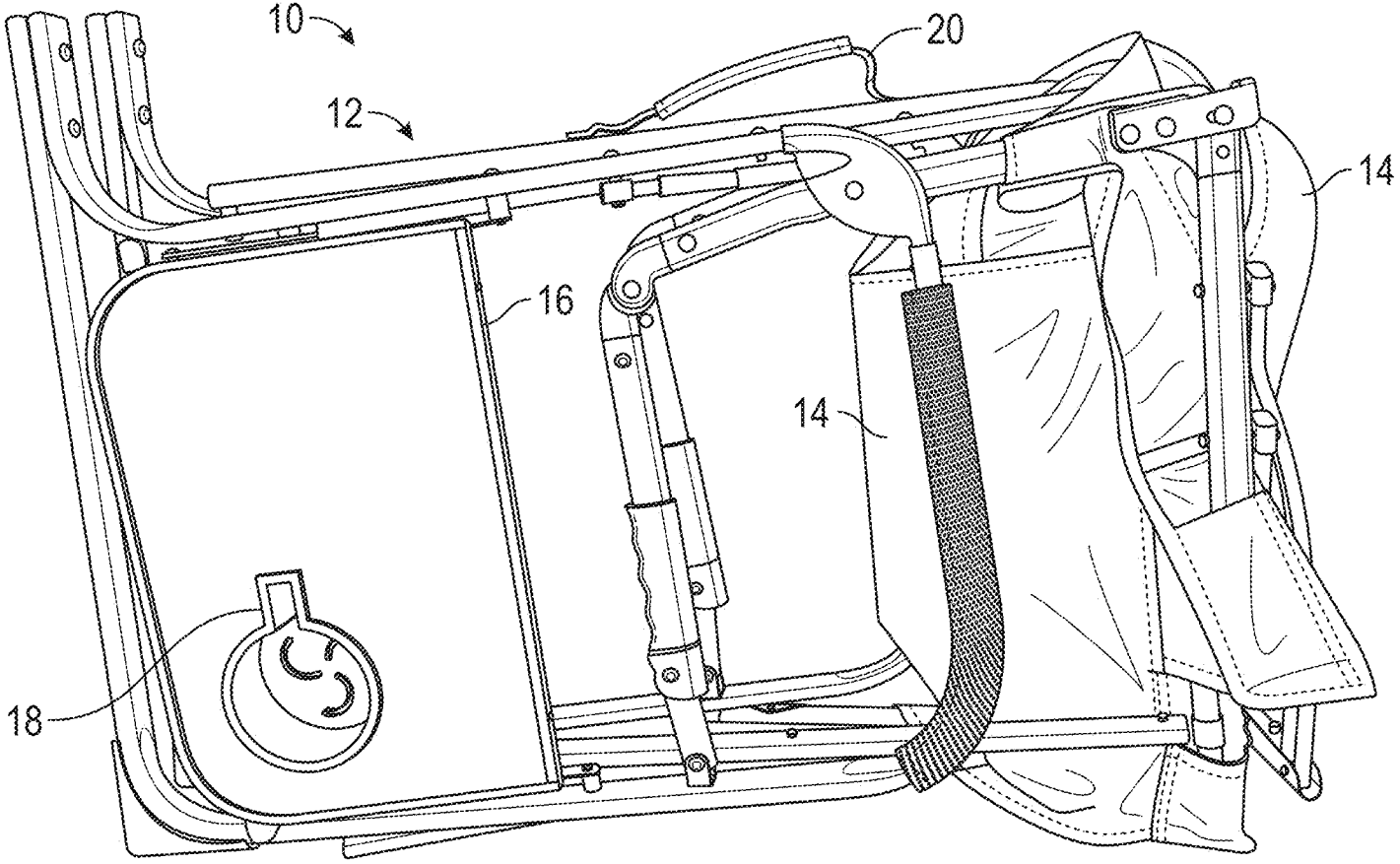
FIG. 1B generally illustrates the reclining foldable chair in a storage position or transportation position, in accordance with at least one embodiment described herein.

FIG. 1A generally illustrates a front view of one example of a reclining foldable chair 10 in one of a plurality of use positions and FIG. 1B generally illustrates the reclining foldable chair 10 in a storage position or transportation position (hereinafter referred to as the storage position for convenience). As can be seen, the overall size of the reclining foldable chair 10 is reduced after transitioning from the use position (FIG. 1A) to the storage position (FIG. 1B), thereby enhancing the portability of the reclining foldable chair 10. The reclining foldable chair 10 may optionally include one or more handles, grips, or the like 20 (as best seen in FIG. 1B) to aid in transportation of the reclining foldable chair 10 when in the storage position.

The reclining foldable chair 10 includes a support frame 12 (also referred to as a collapsible frame) and one or more seat covers 14 secured, coupled, or otherwise mounted to the collapsible frame 12. As explained herein, the support frame 12 may be configured to support the user's weight when in one of the plurality of use positions, while also be configured to collapse such that the overall size of the support frame 12 (and by extension the reclining foldable chair 10) may be reduced when in the storage position. The one or more seat covers 14 may include at least a seat bottom 15 and at least a back rest 17. The seat covers 14 may include any known fabric (e.g., but not limited to, canvas, polyester, neoprene, mesh, woven or non-woven materials, or the like), plastic, or the like. The seat cover 14 may be made from a flexible material that allows the support frame 12 to transition between the use positions and the storage position. The seat cover 14 may include one or more cushions, reflective materials, and/or storage pockets. The seat cover 14 may be secured to the support frame 10 in any manner known to those skilled in the art such as, but not limited to, one or more pockets configured to receive portions of the support frame 12, rivets, screws, bolts, clamps, fasteners, overmolding, or the like.

Figure 2A:
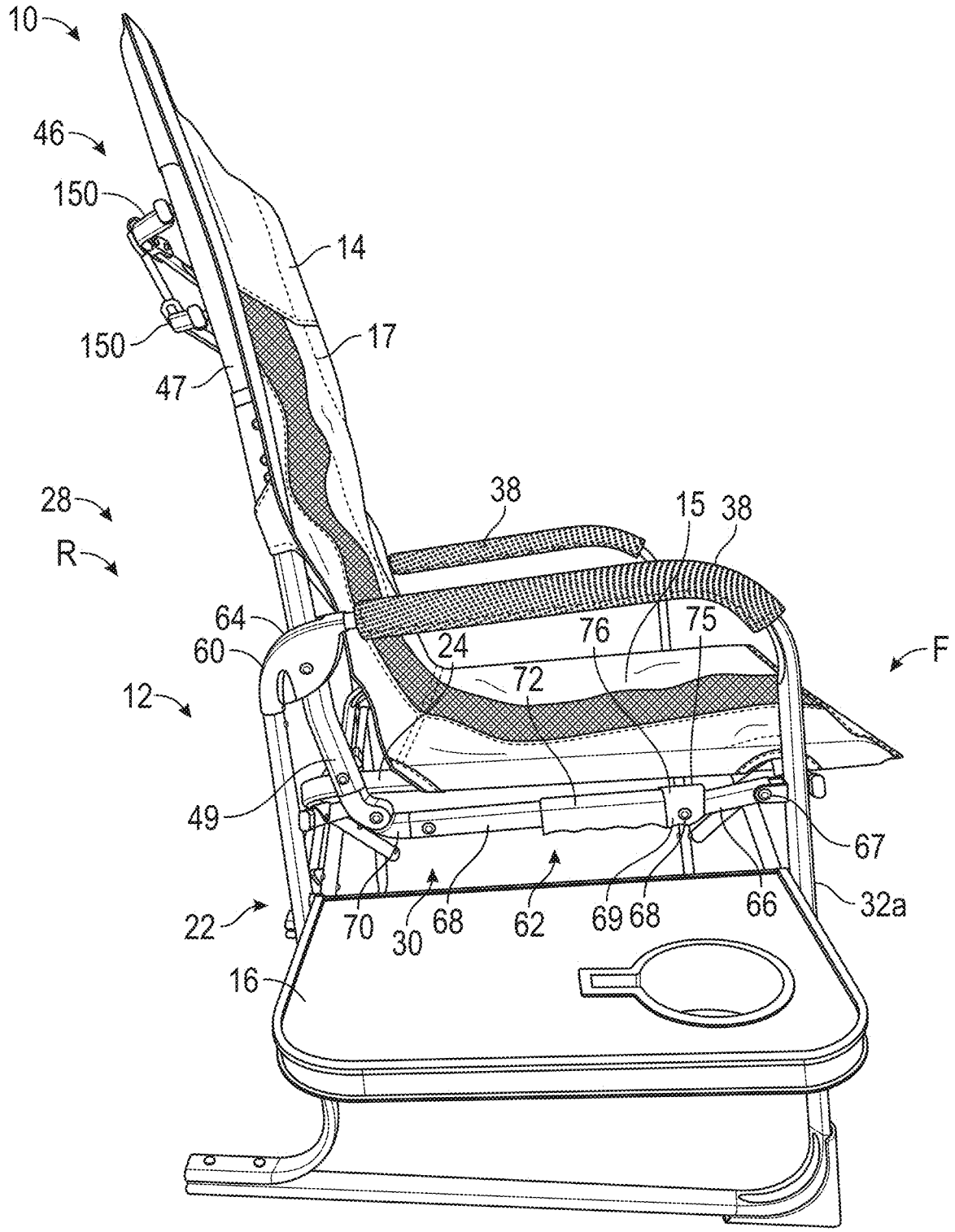
FIG. 2A generally illustrates the reclining foldable chair in an upright position, in accordance with at least one embodiment described herein.
Figure 2B:
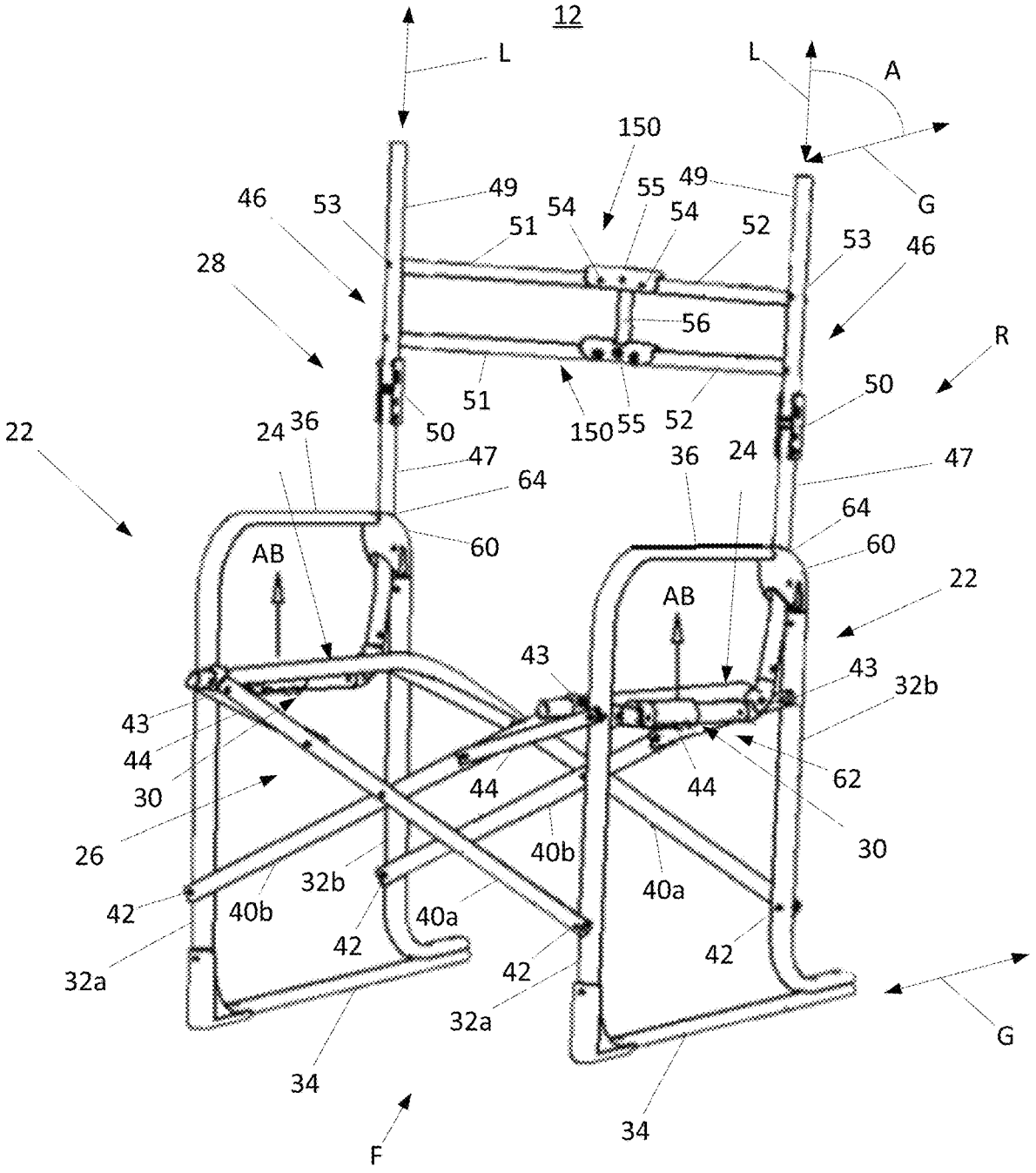
FIG. 2B generally illustrates the reclining foldable chair in the upright position without the seat cover, in accordance with at least one embodiment described herein.
Figure 3A:
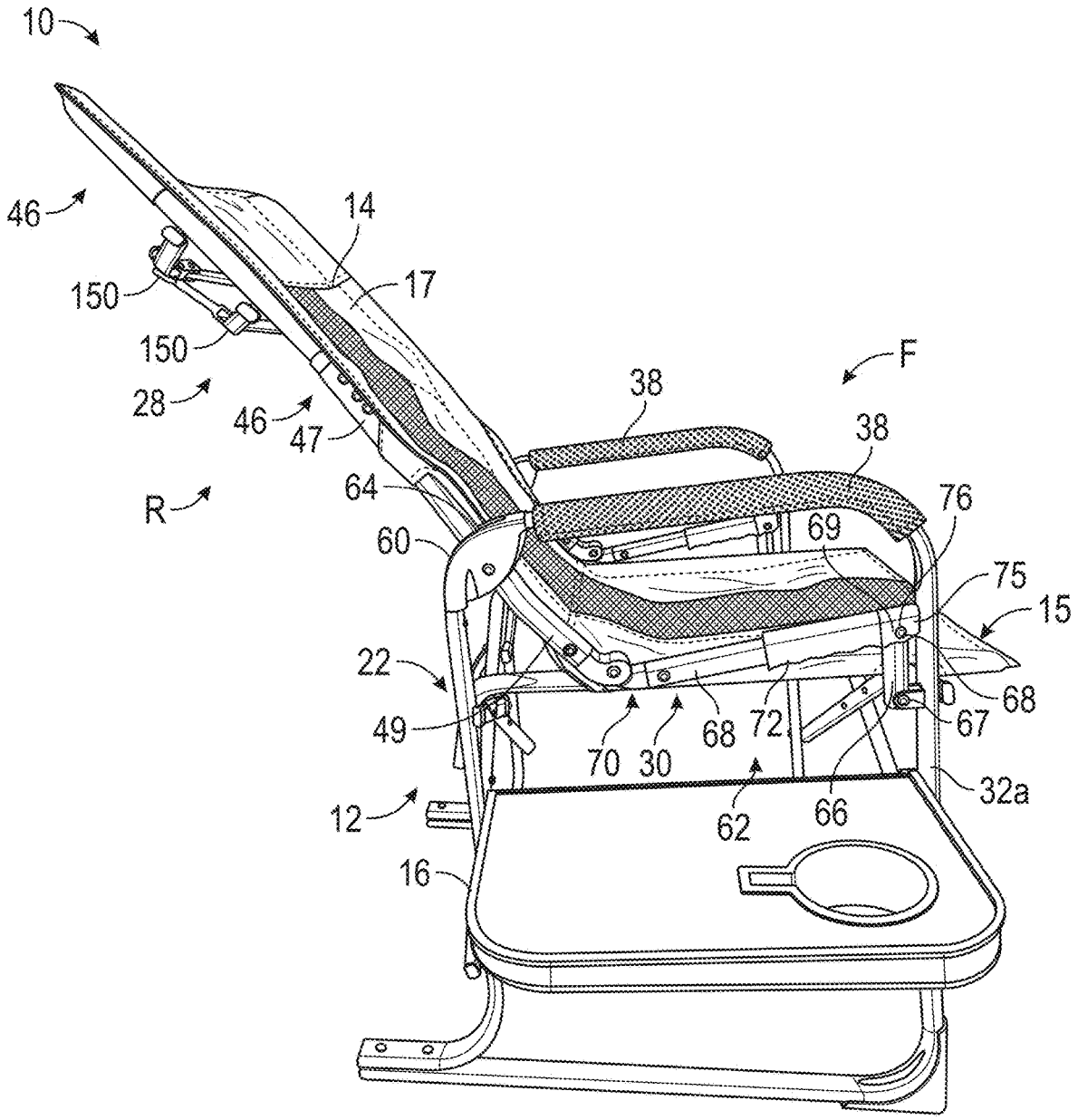
FIG. 3A generally illustrates the reclining foldable chair in a reclined position, in accordance with at least one embodiment described herein.
Figure 3B:
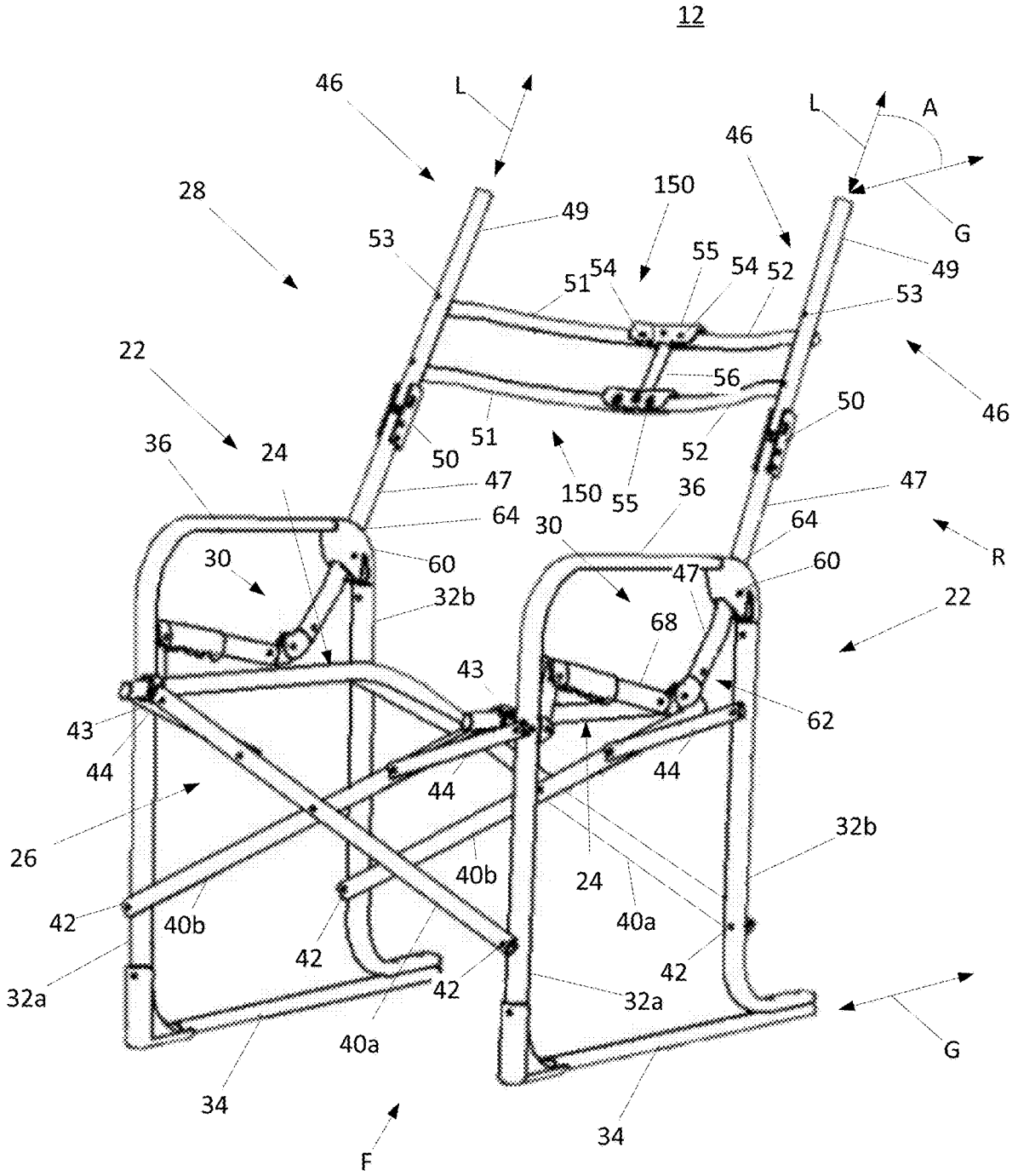
FIG. 3B generally illustrates the reclining foldable chair in a reclined position without the seat cover 14 for clarity, in accordance with at least one embodiment described herein.

Turning now to FIGS. 2A-3B, the reclining foldable chair 10 is shown in multiple use positions. In particular, FIG. 2A generally illustrates the reclining foldable chair 10 in an upright position and FIG. 3A generally illustrates the reclining foldable chair 10 in a reclined position. FIGS. 2B and 3B generally illustrates the reclining foldable chair 10 in the upright and reclined positions, respectively, without the seat cover 14 for clarity.

The support frame 12 may include a left and a right upright 22, one or more seat bottom supports 24, one or more collapsible cross-braces 26, a seat back rest 28, and one or more reclining assemblies 30. The left and right uprights 22 may include one or more support legs 32*a-b*. In the illustrated example, the left and right uprights 22 each include a forward support leg 32*a* and rearward support leg 32*b* that extends substantially vertical with respect to the ground; however, it should be appreciated that the uprights 22 may have more or less than two support legs 32. The forward and rearward support leg 32*a, b* may optionally be coupled to one or more horizontal braces 34. The horizontal braces 34 may increase the rigidity and/or stability of the support legs 32*a, b* and/or may increase the surface area of the reclining foldable chair 10 that contacts the ground, thereby spreading out the user's weight and minimizing pressure points which could cause the reclining foldable chair 10 to dig into the ground while also keeping the chair stable in the recline position. The forward and rearward support leg 32*a, b* may have a fixed length (e.g., distance relative to the ground). Alternatively, the forward and rearward support leg 32*a, b* may be adjustable such that the length of the legs 32*a, b* may be user selected.

The left and right uprights 22 may include one or more arm rests 36. The arm rests 36 may extend between the forward and rearward support leg 32*a, b*, for example, generally opposite the horizontal braces 34. The arm rests 36 may optionally include one or more cushions 38 to enhance the user's comfort. The forward and rearward support leg 32*a, b*, horizontal brace 34, and the arm rest 36 may form a generally rectangular shape, for example, which remains fixed when in the use position and the storage position.

The left and/or right uprights 22 may optionally include one or more storable tables 16 (not shown in FIG. 2B or 3B for clarity). The table 16 may be configured to transition between an extended position (as shown in FIG. 1A) to a retracted position (as shown in FIG. 1B). For example, the table 16 may be pivotally coupled to one or more of the support legs 32*a, b* and may include a locking mechanism 17 configured to lock the table 16 in the extended position such that the table 16 remains in a substantially fixed position relative to the uprights 22 (e.g., generally perpendicular to the uprights 22 and/or horizontal to the ground). It should be understood that the table 16 may be in either the extended position or the retracted position when the reclining foldable chair 10 is in a use position. The table 16 may optionally include one or more drink holders/receptacles 18.

The one or more seat bottom supports 24 may be configured to provide a structure that supports the seat bottom 15 of the seat cover 14. For example, the seat bottom supports 24 may include a left and a right seat bottom support 24 that extend generally forward and rearward (e.g., generally between at least a portion of the forward and rearward support legs 32*a, b*). In the illustrated example, the seat bottom 15 may wrap around at least a portion of the left and right seat bottom supports 24 to couple the seat bottom 15 to the left and right seat bottom supports 24.

The one or more collapsible cross-braces 26 may be configured to couple the left and right uprights 22 together. The collapsible cross-braces 26 may also provide lateral support and allow the support frame 12 to transition to the storage position. In at least one example, the one or more collapsible cross-braces 26 may include a forward and a rearward collapsible cross-brace 26. Each collapsible cross-brace 26 may include a first and a second cross bar 40*a, b*, e.g., configured in an "X" shaped pattern where one cross bar 40*a* is pivotally coupled to the other 40*b* (e.g., in a substantially central location). A first end 42 of the first cross bar 40*a* may be pivotally coupled to the left upright 22 and a second end 43 of the first cross bar 40*a* may be coupled to the right seat bottom support 24. Similarly, a first end 42 of the second cross bar 40*b* may be pivotally coupled to the right upright 22 and a second end 43 of the second cross bar 40*b* may be coupled to the left seat bottom support 24.

One or more of the collapsible cross-braces 26 may optionally include one or more cross-brace links 44. The cross-brace links 44 may be pivotally coupled between the first cross bar 40*a* and the left upright 22 and/or pivotally coupled between the second cross bar 40*b* and the right upright 22. In the illustrated example, the forward and a rearward collapsible cross-braces 26 each include a first and a second cross bar 40*a, b* which provide a support surface for the seat bottom supports 24 to rest against when in the use positions.

Although the illustrated example depicts an "X" shaped collapsible cross-braces 26 when the reclining foldable chair 10 is configured to a use position, any number or shape of collapsible cross-braces 26 may be used including, but not limited to, one or more collapsible support rings, a substantially "Y" shaped collapsible cross-brace 26, and/or a polygonal collapsible cross-brace 26. Further, the collapsible cross-brace 26 may be configured to allow the chair to fold along more than one axis.

Figure 4A:
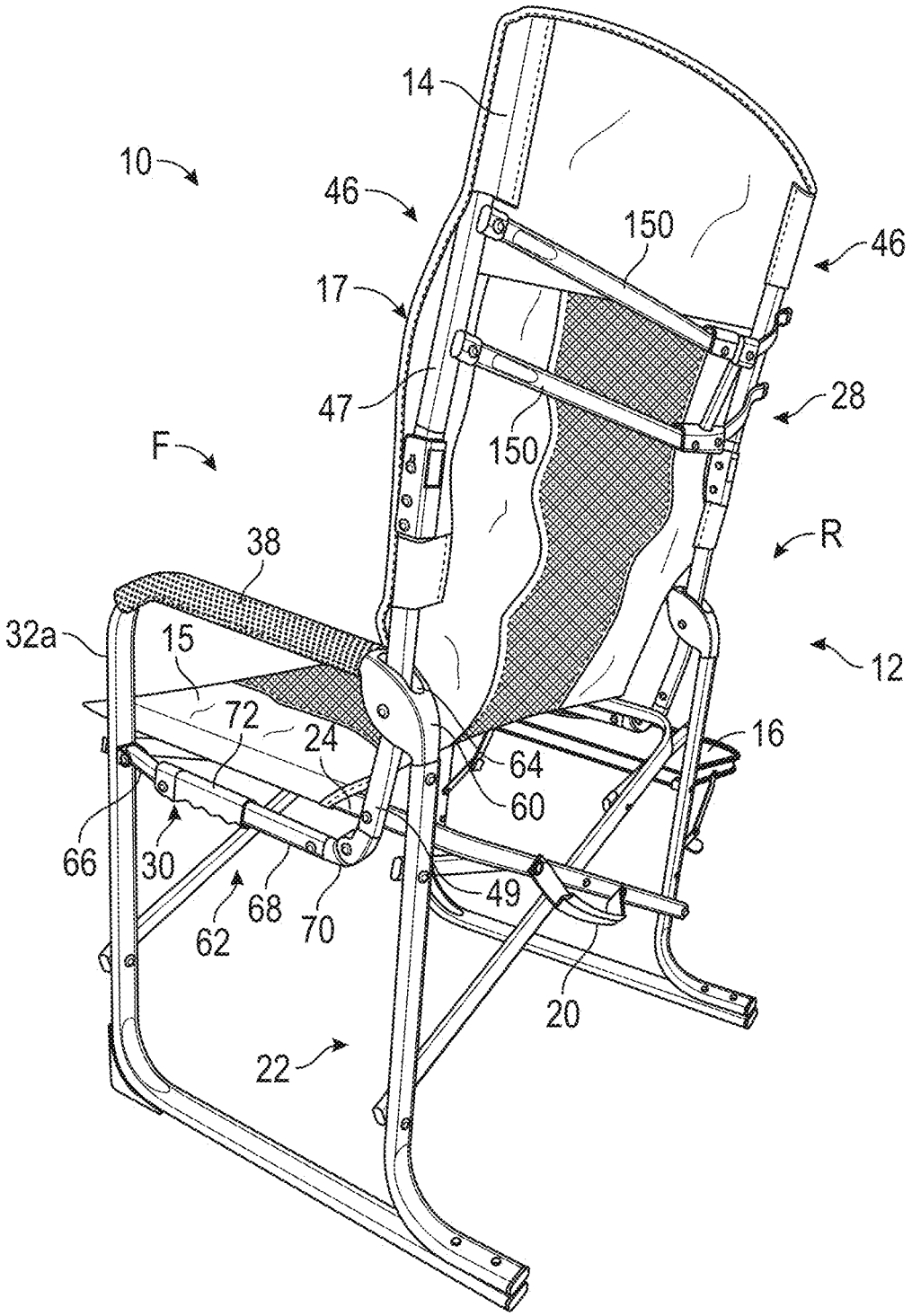
FIGS. 4A-4C generally illustrate the reclining foldable chair in various positions while transitioning from the upright position to the storage position, in accordance with at least one embodiment described herein.
Figure 4B:
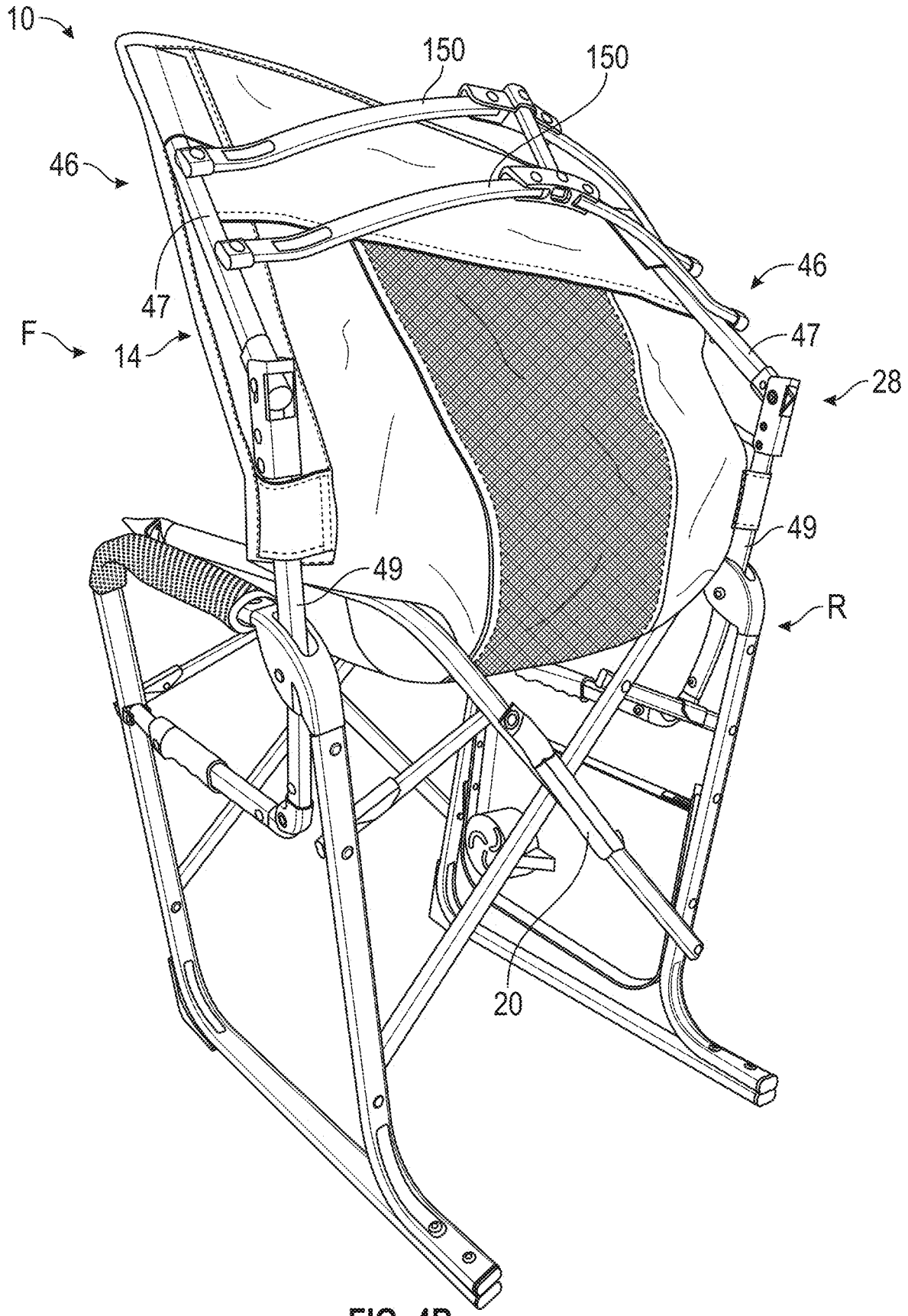
Figure 4C:
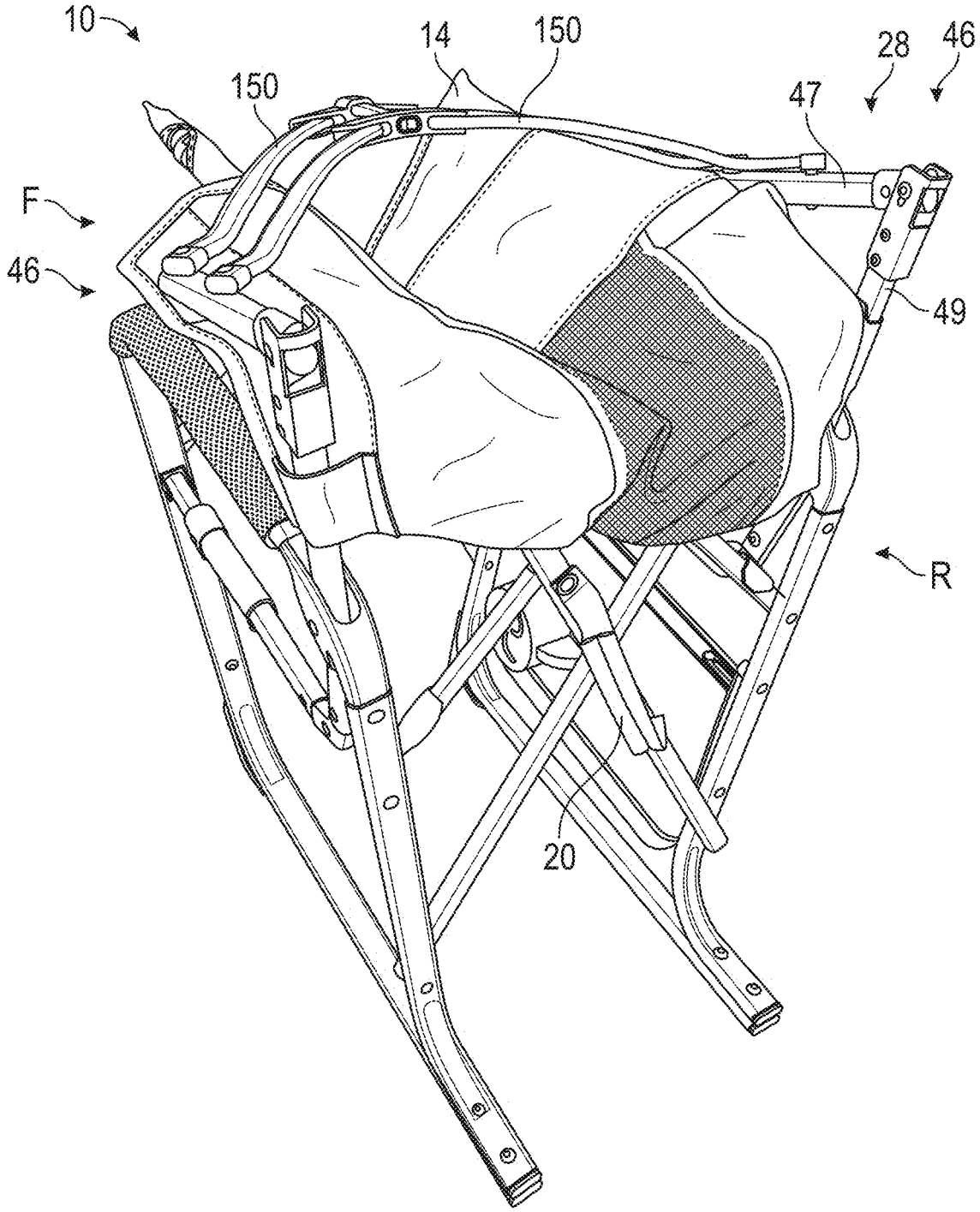

The seat back rest 28 may be configured to provide a structure that supports the back rest 17 of the seat cover 14. For example, the eat back rest 28 may include a left and a right back strut 46 that extend generally up and down relative to the ground (e.g., generally away from the left and/or right uprights 22). In the illustrated example, the back rest 17 may wrap around at least a portion of the left and right back strut 46 to couple the back rest 17 to the left and right back strut 46. The left and right back strut 46 may optionally include two or more strut segments 47, 49 coupled to each other by one or more hinges 50. For example, the left and right back strut 46 may include a lower strut segment 47 and an upper strut segment 49. The hinges 50 may be configured to allow the upper and lower strut segments 47, 49 of the left and right back strut 46 to fold when the reclining foldable chair 10 is transitioned from the use positions to the storage position as generally illustrated in FIGS. 4A-4C. In at least one example, the upper and lower strut segments 47, 49 may be configured to such that the upper strut segment 49 folds relative to the lower strut segment 47 and is generally parallel and proximate to the left and a right seat bottom support 24 when in the storage position (e.g., as generally illustrated in FIG. 4C). By folding the upper strut segment 49 relative to the lower strut segment 47 when in the storage position, the overall height of the seat back rest 28 may be increased while in a use position and the overall size of the reclining foldable chair 10 may be reduced when in the storage position. The use of a longer/taller seat back rest 28 may be particularly beneficial when used in combination with the reclining assemblies 30 since it allows for greater head/neck support, particularly when the reclining foldable chair 10 is in the reclined position. The hinges 50 may also be configured to limit rotation of the upper and lower strut segments 47, 49 such that the longitudinal axes of the upper and lower strut segments 47, 49 are substantially straight relative to each other (e.g., 180 degrees+/−10 degrees).

The seat back rest 28 may optionally include one or more backrest supports 150. The backrest supports 150 may be configured to couple the left and right back strut 46 together when in the use positions, thereby enhancing the rigidity and/or stability of the seat back rest 28. The backrest supports 150 may also support the weight of the user when leaning against the back rest 17 of the seat cover 14. The backrest supports 150 may have a non-linear (e.g., curved) shape configured to generally cradle or generally conform to the shape of the user's back when the user is in the seat position.

Each backrest support 150 may include at least a first and a second segment 51, 52. The first ends 53 of the first and second segments 51, 52 are pivotally coupled to the left and right back strut 46 (e.g., the left and right upper strut segment 47), respectively, while the second ends 54 of the first and second segments 51, 52 are hingedly coupled to each other (e.g., by way of a hinge 55). The hinge 55 allows the first and second segment 51, 52 of the seat back rest 28 to move towards each other when the reclining foldable chair 10 is transitioned to the storage position.

The hinges 55 may also be configured to limit rotation of the first and second segment 51, 52 such that the longitudinal axes of the first and second segment 51, 52 are substantially straight relative to each other (e.g., 180 degrees+/−10 degrees). In the illustrated example, the seat back rest 28 is shown having an upper and lower backrest support 50. The upper and lower backrest supports 150 may be generally parallel to each other. The upper and lower backrest supports 150 may optionally be coupled together by way of one or more spine supports 56. The spine supports 56 may provide rigidity to the upper and lower backrest supports 150 and may further support a seated user. Although the spine support 56 is shown to be linear, it is understood that the spine support 56 may be curved, curvilinear, etc. as is desirable. The spine support 56 may be disposed along any point of the upper and lower backrest supports 150. In the illustrated example, the spine support 56 may be secured to the hinges 55 of the upper and lower backrest supports 150.

Figure 5:
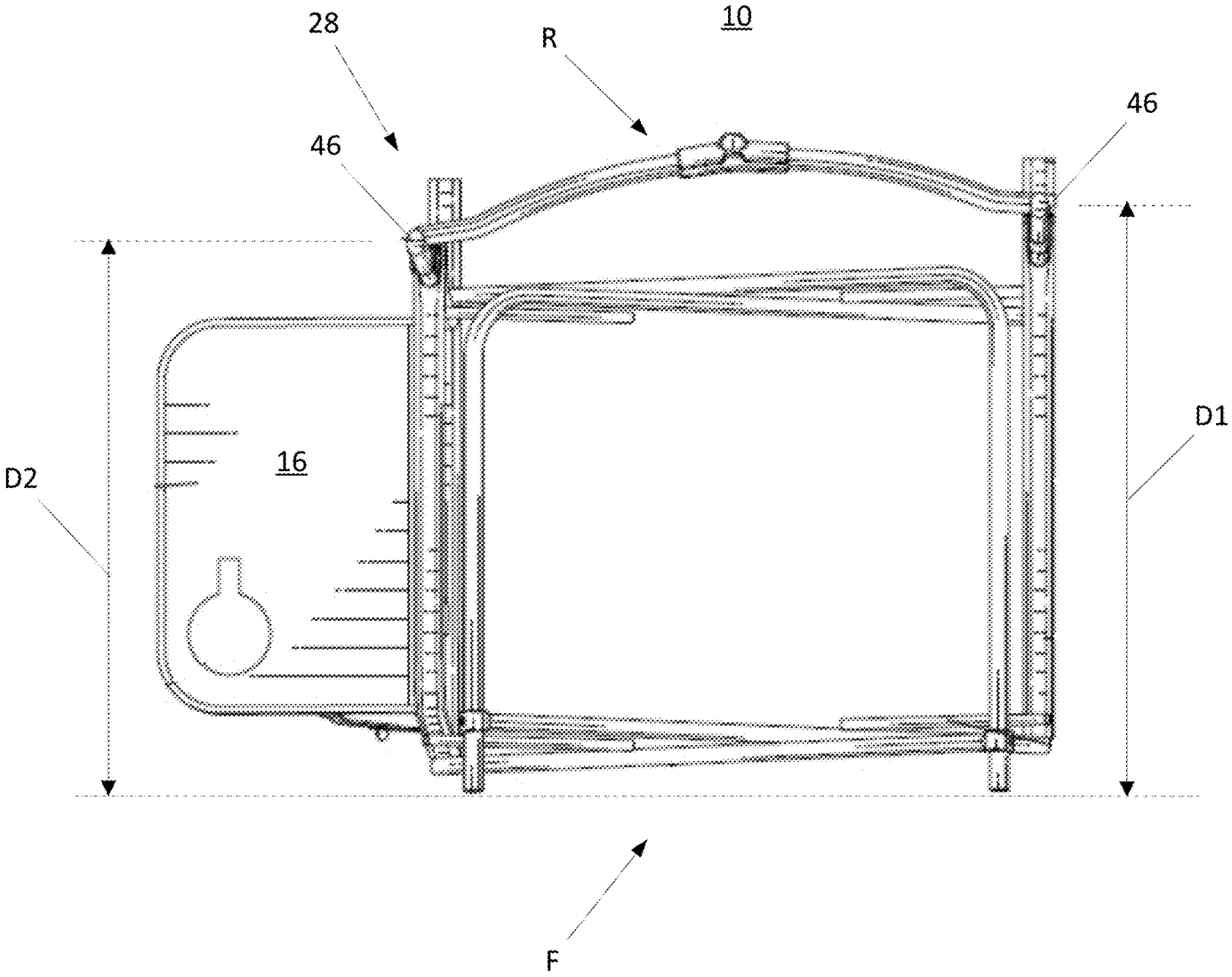
FIG. 5 generally illustrates a top view of the reclining foldable chair, in accordance with at least one embodiment described herein.

With reference to FIG. 5, a top view of the reclining foldable chair 10 is generally illustrated. In at least one example, the left and right back strut 46 of the seat back rest 28 may be off-centered/not level with each other. In particular, the left strut 46 may be positioned a distance D1 which is further from the front of the reclining foldable chair 10 while the right strut 46 may be positioned a distance D2 which is closer to the front of the reclining foldable chair 10. The offsetting of the left and right struts 46 may facilitate collapsing of the reclining foldable chair 10 into the storage position.

The reclining assemblies 30 are configured to allow the user to transition the reclining foldable chair 10 between multiple use positions, e.g., between an upright position (as generally illustrated in FIGS. 2A and 2B) and one or more reclined positions (as generally illustrated in FIGS. 3A and 3B). In the illustrated example, the reclining foldable chair 10 includes a left and a right reclining assembly 30; however, it should be appreciated that the reclining foldable chair 10 may include a single reclining assembly 30. In the upright position, a longitudinal axis L of the seat back rest 28 may be arranged at an angle A of between about 80 degrees to 100 degrees relative to the plane of the ground G. In the reclined position, the longitudinal axis L of the seat back rest 28 may be arranged at an angle A of less than 89 degrees relative to the plane of the ground G such that the seat back rest 28 extends generally away from the seat bottom supports 24 and away from the front F of the reclining foldable chair 10, for example, at an angle less than 75 degrees, less than 70 degrees, less than 65 degrees, less than 53 degrees, and/or any range or value therein. In some embodiments, any of the preceding reclined angle ranges may have a lower limit of at least 20 degrees, at least 30 degrees, and/or at least 45 degrees. Alternatively, the lower limit of the reclined angle may be substantially zero relative to the ground such that the seat back rest 28 is substantially parallel to the ground. In at least one example, the reclining foldable chair 10 may be arranged at an angle A of between about 90 degrees to about 89 degrees when in the upright position and less than about 89 degrees to greater than 50 degrees when in the reclined position (e.g., about 53 degrees). In another example, the reclining foldable chair 10 recline about 30-40 degrees (e.g., 36 degrees) from the upright position to the reclined position. In the illustrated example, the reclining foldable chair 10 may be locked in to use positions (e.g., the upright position and the reclined position), though it should be appreciated that the reclining foldable chair 10 may lock in more than two positions (e.g., may have multiple reclined positions).

The single reclining assembly 30 may include a recline limiter 60 and a pivoting link latch 62. The recline limiter 60 includes an elongated slot 64 configured to allow the seat back rest 28 (e.g., the left and right back strut 46, and more specifically, for example to the lower strut segments 49) to pass through. The seat back rest 28 (e.g., the left and right back strut 46, and more specifically, for example to the lower strut segments 49) may be pivotally coupled to the recline limiter 60 such that the seat back rest 28 may pivot relative to the recline limiter 60 but cannot otherwise move relative to the recline limiter 60. The size and shape of the elongated slot 64 may limit movement of the seat back rest 28 in the reclined position (e.g., may set the lower limit of the angle of the seat back rest 28 relative to the ground as discussed above).

The pivoting link latch 62 may include a pivoting link 66 and a moving link 68 in which the overall length between opposite ends of the pivoting link 66 and the moving link 68 may be adjusted by the user in order to transition the reclining foldable chair 10 between the upright position and the reclined position. The pivoting link 66 includes a first end 67 pivotally coupled to the support frame 12 (e.g., the forward support leg 32*a*) such that the pivoting link 66 pivots relative to the support frame 12, but otherwise does not move relative to the support frame 12. The pivoting link 66 also includes a second end 68 that is pivotally coupled to a first end 69 of the moving link 68. A second end 70 of the moving link 68 is pivotally coupled to the seat back rest 28 (e.g., the left and right back strut 46, and more specifically, for example to the lower strut segments 49).

When the pivoting link 66 and the moving link 68 are in substantially straight line relative to each other (e.g., the longitudinal axes of the pivoting link 66 and the moving link 68 are substantially colinear) as generally illustrated in FIGS. 2A and 2B, the overall length of the pivoting link 66 and the moving link 68 (e.g., the separation distance between opposite ends of the pivoting link 66 and the moving link 68) is at its longest. In contrast, when the pivoting link 66 and the moving link 68 pivot relative to each other (e.g., are in a bent position) as generally illustrated in FIGS. 3A and 3B, the overall length of the pivoting link 66 and the moving link 68 (e.g., the separation distance between opposite ends of the pivoting link 66 and the moving link 68) is reduced. The moving link 68 may optionally include a grip or the like 72 configured to allow a user to apply a force (e.g., an upward force) as indicated by the arrow AB to the moving link 68 to urge the pivoting link 66 and moving link 68 from the colinear configuration (as generally illustrated in FIGS. 2A and 2B) to the bent position (as generally illustrated in FIGS. 3A and 3B). Similarly, the user may apply a force with the grip 72 to the moving link 68 in the opposite direction or arrow AB in order to urge the pivoting link 66 and moving link 68 from the bent configuration to the colinear position.

Notably, when the pivoting link 66 and the moving link 68 are in substantially straight line relative to each other, forces transmitted by the seat back rest 28 (e.g., the weight of the user when seated) will be transmitted generally along the same vector within both the pivoting link 66 and the moving link 68. As such, the forces will generally not cause the pivoting link 66 and the moving link 68 to move relative to each other. In some examples, the pivoting link 66 and/or the moving link 68 may include a flange 75 that limits movement of the pivoting link 66 and the moving link 68 in one direction. By way of an example, the flange 75 may extend from the moving link 68 beyond the pivot joint 76. When the user applies a force in the opposite direction of arrow AB, the flange 75 may limit movement of the pivoting link 66 and the moving link 68 such that the moving link 68 is moved from an acute angle relative to the pivoting link 66 (i.e., when in the reclined position) to a substantially colinear angle, a slight obtuse angle, or a slight reflex angle when in the upright position. A slight obtuse angle is defined to mean an angle between 170 degrees and less than 180 degrees and a reflex acute angle is defined herein to mean an angle greater than 180 degrees and less than 190 degrees. The flange 75 may further aid in retaining the pivoting link 66 and moving link 68 in the substantially straight line.

The pivoting link latch 62 may be thought of as a first leg of a triangle, the seat back rest 28 may be thought of as a second leg of the triangle, and the distance between the first end 67 of the pivoting link 66 and the distal end of the seat back rest 28 may be thought of as the third leg or hypotenuse of the triangle. Because the position of the first end 67 of the pivoting link 66 is fixed relative to the upright 22 and the seat back rest 28 can only pivot relative to the recline limiter 60, changing the overall length of the pivoting link latch 62 (i.e., the first leg of the triangle) will change the angle of the seat back rest 28 since the length of the seat back rest 28 is fixed. As such, when the pivoting link 66 and the moving link 68 are in substantially straight line relative to each other as generally illustrated in FIGS. 2A and 2B, the overall length of the pivoting link latch 62 is at its longest and angle between the pivoting link latch 62 and the seat back rest 28 is minimized resulting in the seat back rest 28 being in the upright position. In contrast, when the pivoting link 66 and the moving link 68 pivot relative to each other and are in the bent position as generally illustrated in FIGS. 3A and 3B, the overall length of the pivoting link latch 62 is reduced and angle between the pivoting link latch 62 and the seat back rest 28 is increased resulting in the seat back rest 28 being in the reclined position.

The term substantially, as generally referred to herein, refers to a degree of precision within acceptable tolerance that accounts for and reflects minor real-world variation due to material composition, material defects, and/or limitations in manufacturing processes. Such variation may therefore be said to achieve largely, but not necessarily wholly, the target/nominal characteristic. To provide one non-limiting numerical example to quantify "substantially," such a modifier is intended to include minor variation that can cause a deviation of up to and including ±10% from a particular stated quality/characteristic unless otherwise provided by the present disclosure.

The term "coupled" as used herein refers to any connection, coupling, link or the like between elements/components. In contrast, directly coupled refers to two elements in contact with each other in a manner that does not include an intermediate element/component disposed therebetween.

The use of the terms "first," "second," and "third" when referring to elements herein are for purposes of clarity and distinguishing between elements, and not for purposes of limitation. Likewise, like numerals are utilized to reference like elements/components between figures.

While the principles of the disclosure have been described herein, it is to be understood by those skilled in the art that this description is made only by way of example and not as a limitation as to the scope of the disclosure. Other embodiments are contemplated within the scope of the present disclosure in addition to the exemplary embodiments shown and described herein. It will be appreciated by a person skilled in the art that any smart drain system described herein may embody any one or more of the features contained herein and that the features may be used in any particular combination or sub-combination. Modifications and substitutions by one of ordinary skill in the art are considered to be within the scope of the present disclosure, which is not to be limited except by the claims.

What is claimed is:

1. A reclining foldable chair comprising:

a support frame configured to transition between a storage position and a use position, the seat support frame comprising:

a first and a second upright;

one or more seat bottom supports;

one or more collapsible cross-braces;

a seat back rest; and one or more reclining assemblies configured to allow the reclining foldable chair to transition between an upright position and one or more reclined positions, the one or more reclining assemblies including a recline limiter and a pivoting link latch, the pivoting link latch including a pivoting link and a moving link, wherein the moving link includes a grip configured to allow a user to apply a force to the moving link to urge the pivoting link and moving link from the substantially straight line position to the bent position; and one or more seat covers secured to the support frame.

2. The reclining foldable chair of claim 1, wherein the recline limiter includes an elongated slot configured to allow the seat back rest to pass through, wherein the seat back rest is pivotally coupled to the recline limiter such that the seat back rest pivots relative to the recline limiter but cannot otherwise move relative to the recline limiter.

3. The reclining foldable chair of claim 2, wherein the elongated slot is configured to limit movement of the seat back rest in at least one of the one or more reclined positions.

4. The reclining foldable chair of claim 1, wherein an overall length between opposite ends of the pivoting link and the moving link is adjustable in order to transition the reclining foldable chair between the upright position and the one or more reclined positions.

5. The reclining foldable chair of claim 1, wherein the pivoting link includes:

a first end pivotally coupled to the support frame such that the pivoting link is configured to pivot relative to the support frame, but otherwise does not move relative to the support frame; and a second end that is pivotally coupled to a first end of the moving link; and wherein a second end of the moving link is pivotally coupled to the seat back rest.

6. The reclining foldable chair of claim 1, wherein the pivoting link and the moving link are configured to be aligned at an acute angle when the reclining foldable chair is in one or more reclined positions and a substantially colinear position when the reclining foldable chair is in the upright position.

7. The reclining foldable chair of claim 1, wherein the pivoting link and the moving link each include a longitudinal axis, and wherein when the pivoting link and the moving link are aligned in a substantially straight line position such that the longitudinal axes of the pivoting link and the moving link are substantially colinear, the separation distance between opposite ends of the pivoting link and the moving link is at its longest.

8. The reclining foldable chair of claim 7, wherein the pivoting link and the moving link each include a longitudinal axis, and wherein when the pivoting link and the moving link pivot are aligned in a bent position relative to each other, the separation distance between opposite ends of the pivoting link and the moving link is reduced compared to the substantially straight line position.

9. The reclining foldable chair of claim 1, wherein when the pivoting link and the moving link are in the substantially straight line position, forces transmitted by the seat back rest are transmitted generally along a common vector within both the pivoting link and the moving link.

10. The reclining foldable chair of claim 1, further comprising a flange configured to limit movement of the pivoting link and the moving link in one direction.

11. The reclining foldable chair of claim 10, wherein the flange is configured to extend from the moving link beyond a pivot joint coupling the pivoting link to the flange and over a portion of the moving link such that the flange limits movement of the pivoting link and the moving link when the moving link is moved from the one or more reclined positions to the upright position.

12. The reclining foldable chair of claim 10, wherein the flange is configured to aid in retaining the pivoting link and moving link in a substantially straight line when in the upright position.

13. The reclining foldable chair of claim 1 further comprising a storable table configured to transition between an extended position and a retracted position.

14. The reclining foldable chair of claim 13, wherein the storage table is pivotally coupled to the first upright and includes a locking mechanism configured to lock the storage table in the extended position such that the storage table remains in a substantially fixed position relative to the first upright.

15. The reclining foldable chair of claim 1, wherein the seat back rest includes a left and a right back strut that extend generally away from the left and right uprights.

16. The reclining foldable chair of claim 15, wherein the left and right back strut each include a lower strut segment and an upper strut segment coupled to each other by a hinge.

17. The reclining foldable chair of claim 16, wherein the hinges are configured to allow the upper and lower strut segments of the left and right back strut to fold when the reclining foldable chair is transitioned from the use positions to the storage position.

18. The reclining foldable chair of claim 17, wherein:

the one or more seat bottom supports includes a left and a right seat bottom support; and the upper strut segment folds relative to the lower strut segment and is generally parallel and proximate to the left and a right seat bottom support when in the reclining foldable chair is in the storage position.

* * * * *